United States Patent [19]

Block et al.

[11] Patent Number: 5,068,015

[45] Date of Patent: Nov. 26, 1991

[54] ELECTROCHEMICAL PROCESS FOR THE PRODUCTION OF CHROMIC ACID

[75] Inventors: Hans-Dieter Block; Norbert Lönhoff, both of Leverkusen; Bernd Makowka; Helmut Klotz, both of Bergisch Gladbach; Rainer Weber; Bernhard Spreckelmeyer, both of Leverkusen, all of Fed. Rep. of Germany

[73] Assignee: Bayer Aktiengesellschaft, Leverkusen, Fed. Rep. of Germany

[21] Appl. No.: 393,733

[22] Filed: Aug. 15, 1989

[30] Foreign Application Priority Data

Aug. 27, 1988 [DE] Fed. Rep. of Germany ..... 3829121

[51] Int. Cl.[5] ..... C25B 1/22

[52] U.S. Cl. ..... 204/89

[58] Field of Search ..... 204/89, 97, 59 R; 423/54

[56] References Cited

FOREIGN PATENT DOCUMENTS 739447 7/1966 Canada ..... 204/97

OTHER PUBLICATIONS

Mulokozi et al., "Selective Separation of Chromium from Other Elements by Ion-Exchange-11"; vol. 22, No. 3, Mar. 1975, pp. 239-244.

Perry et al., Chemical Engineers' Handbook; 5th Edition, 1973, pp. 16-2 to 16-4 and 16-10 to 16-12.

"Ullmann's Encyclopedia of Industrial Chemistry"; Chromium Compounds; vol. A7; pp. 66-97.

*Primary Examiner*—John Niebling

*Assistant Examiner*—Kathryn Gorgos

*Attorney, Agent, or Firm*—Sprung Horn Kramer & Woods

[57] ABSTRACT

A process for the production of chromic acid by the multistage electrolysis of dichromate and/or monochromate solutions in two-compartment electrolysis cells, of which the anode and cathode compartments are separated by cation exchanger membranes, at temperatures in the range from 50° to 90° C., the dichromate and/or monochromate solutions being obtained by the digestion of chrome ores and leaching, the improvement wherein, optionally after the removal of aluminum, vanadium and other impurities, the monochromate solution obtained after leaching is adjusted at 20° to 110° C. to a pH value of from 8 to 12 by the addition and/or in situ formation of carbonate in a quantity of from 0.01 to 0.18 mol/l (for 300 to 500 g/l $Na_2CrO_4$, converted with $CO_2$ under pressure into a dichromate-containing solution, the dichromate-containing solution is introduced into the anode compartment of the electrolysis cell, a solution containing chromic acid, in which the molar ratio of Na ions to chromic acid is from 0.45:0.55 to 0.30:0.70, is electrolytically produced and the chromic acid is worked up by crystallization, washing and drying.

10 Claims, No Drawings

ELECTROCHEMICAL PROCESS FOR THE PRODUCTION OF CHROMIC ACID

BACKGROUND OF THE INVENTION

This invention relates to an electrochemical process for the production of high-purity chromic acid ($CrO_3$) comprising the following steps:

1. preparing and purifying an aqueous sodium chromate/sodium dichromate solution, 2. converting the sodium chromate/sodium dichromate solution into a sodium dichromate/chromic acid solution with a molar ratio of sodium ions to chromic acid of 0.45:0.55 to 0.30:0.7 by multistage membrane electrolysis, 3. crystallizing solid chromic acid from this sodium dichromate/chromic acid solution by evaporation to a water content of approximately 9 to 20% by weight and preferably 12 to 15% by weight $H_2O$ at temperatures in the range from 55° C. to 110° C., 4. separating the chromic acid crystallized out from the mother liquor by centrifugation and washing out of the adhering mother liquor with a substantially saturated chromic acid solution having a temperature of at least 55° C. and removing the washing solution by centrifugation, 5. recirculating the mother liquor separated off in the centrifuge into a middle stage of the multistage membrane electrolysis mentioned in 2. and, at the same time, removing a small amount of the mother liquor to remove impurities from the electrolysis/crystallization circuit.

Chromic acid ($CrO_3$) is industrially produced by three different processes:

In the so-called melt process, sodium dichromate crystals are reacted with concentrated sulfuric acid in a molar ratio of approximately 1:2 at temperatures of around 200° C. In the so-called wet process, sulfuric acid and sodium dichromate are combined with one another in concentrated aqueous solution. In both processes, sodium bisulfate contaminated with chromium is unavoidably formed either as a melt or as an aqueous solution.

This disadvantage and the accompanying losses of chromium is avoided by the third process, namely the membrane electrolysis of sodium dichromate in aqueous solution. The electrochemical process, which is described for example in Canadian patent specification A-739,447, is based on the principle common to membrane electrolyses using a cation-selective membrane, namely the migration of the cations in an anode compartment through the cationselective membrane forming the dividing wall between the anode and cathode compartments into the cathode compartment under the effect of the electrical field.

Embodiments of the electrochemical process for the production of chromic acid are described in Canadian patent specification A-739,447. From a sodium dichromate solution introduced into an anode compartment, the sodium ions in the electrical field migrate through the membrane into the cathode compartment filled with water or aqueous solution and, with the hydroxide ions formed at the cathode with evolution of hydrogen, form an aqueous solution containing sodium ions while, in the anode compartment, the dichromate ions remaining behind are electrically neutralized by the hydrogen cations formed at the anode with simultaneous evolution of oxygen.

Broadly speaking, therefore, this process comes down to the substitution of the sodium ions in the sodium dichromate by hydrogen ions, i.e. to the formation of chromic acid. During the conversion of the sodium dichromate solution into a sodium dichromate solution containing an increasing quantity of chromic acid, the migration of the sodium ions through the membrane is increasingly accompanied by the migration of the hydrogen ions formed in the anode compartment, so that the utilization of the electric current for the desired removal of sodium from the anode compartment, also known as the current efficiency, steadily decreases. This means that the sodium dichromate cannot be completely converted into chromic acid in the anode compartment, and the conversion is only operated to an average degree on economic grounds. The chromic acid then has to be separated off from these solutions by fractional crystallization, leaving a mother liquor containing the sodium dichromate which has not been electrochemically converted and residues of non-crystallized chromic acid. This solution is conveniently introduced into the electrolysis process for further conversion into chromic acid. The following problems ensue from these process principles: on the one hand, the mother liquor adhering to the chromic acid crystals and consisting of almost concentrated sodium dichromate solution has to be carefully washed to obtain a pure product; on the other hand, all impurities introduced with the sodium dichromate solution collect in the system and are ultimately discharged with and in the chromic acid crystals because only the electrolysis gases, hydrogen and oxygen, leave the process and the membrane separating off the anode compartment is largely impermeable to anions and also to polyvalent cations. Accordingly, it is not possible by this process to obtain high-purity chromic acid. In addition, cationic impurities in the sodium dichromate solution introduced, particularly polyvalent cations, lead to premature exhaustion and destruction of the membrane separating the anode and cathode compartments, probably because precipitations of insoluble hydroxides and salts of these cations occur as a result of the major pH changes taking place within the membrane in very thin layers.

DE-A 3 020 261 describes a process for electrochemical production of chromic acid from dichromate, of which the object is to enable the production of chronic acid to be carried out with high current efficiency and to eliminate the impurities introduced with the dichromate.

The process according to DE-A 3 020 261 is essentially characterized by the use of a three-compartment cell, the dichromate solution entering the middle compartment and leaving it again in dichromate-depleted form and, as it flows through, releasing sodium ions to the cathode compartment separated off by a cation-selective membrane and dichromate ions to the anode compartment separated off by a diaphragm or an anion-selective membrane. Although it is possible in this way to produce a chromic acid solution substantially free from impurities, a high voltage is required for the electrolysis process on account of the large electrode intervals enforced by the middle compartment. Accordingly, this process is unsatisfactory on account of the complicated and vulnerable three-compartment structure.

DE-A 3 020 260 describes the purification of sodium chromate solution for the electrochemical production of chromic acid. In this purification process, the sodium chromate solution is subjected to electrolysis in the anode compartment of a two-compartment cell with a cation-selective partition and the cationic impurities are precipitated in the membrane with simultaneous formation of sodium dichromate in the anode compartment and of an alkaline solution containing sodium ions in the cathode compartment, as known per se from U.S. Pat. No. 3,305,463. The sodium chromate/sodium dichromate solution thus purified is electrochemically converted into chromic acid in the manner described above. Two major disadvantages, namely the frequent replacement or purification of the very expensive membrane charged with the contaminated cations and the necessary conversion of the sodium chromate used into sodium dichromate solely with electric current rather than the considerably less expensive inorganic acids, sulfuric acid or carbon dioxide, make the proposed process economically unattractive.

Accordingly, the object of the present invention is to provide a process which, while retaining the advantages of the electrochemical production of chromic acid, enables a high-purity, crystalline chromic acid to be produced under economic conditions.

SUMMARY OF THE INVENTION

Accordingly, the present invention relates to a process for the production of chromic acid by the multistage electrolysis of dichromate and/or monochromate solutions in two-compartment electrolysis cells, of which the anode and cathode compartments are separated by cation exchanger membranes, at temperatures in the range from 50° to 90° C., the dichromate and/or monochromate solutions being obtained by the digestion of chrome ores and leaching, characterized in that, optionally after the removal of aluminum, vanadium and other impurities, the monochromate solution obtained after leaching is adjusted at 20° to 110° C. to a pH value of from 8 to 12 by the addition and/or in situ formation of carbonate in a quantity of from 0.01 to 0.18 mol/l (for 300 to 500 g/l $Na_2CrO_4$), the carbonates or hydroxides precipitated are separated off, the solution is concentrated to a content of 750 to 1000 g/l $Na_2CrO_4$, converted with $CO_2$ under pressure into a dichromate-containing solution, the dichromate-containing solution is introduced into the anode compartment of the electrolysis cell, a solution containing chromic acid, in which the molar ratio of Na ions to chromic acid is from 0.45:0.55 to 0.3:0.7, is electrolytically produced and the chromic acid is worked up by crystallization, washing and drying.

DESCRIPTION OF THE PREFERRED EMBODIMENTS

In one preferred embodiment, the process is carried out as follows:

1. By leaching the furnace clinker produced using lowsulfur fuels and leaving the chrome ore digestion furnace with water and adjusting the pH value to 7–9.5 with dichromate solution and/or another mineral acid, a sodium dichromate solution having a sodium chromate content of from about 300 to 500 g/l is produced and is optionally freed from co-dissolved vanadate in known manner by precipitation at pH 10 to 13.

2.This solution is then adjusted at 20° C. to 110° C. and preferably at 60° to 90° C. to pH values of from 8 to 12 and preferably in the range from 9 to 11 by addition of sodium hydroxide and carbon dioxide or by addition of sodium carbonate in a quantity corresponding to approximately 0.03 to 0.1 mol/l carbonate in order to precipitate the polyvalent cations as poorly soluble carbonates and/or hydroxides; the precipitation may even be carried out in several stages with increasing contents of sodium chromate. A sodium chromate solution freed from polyvalent cations to less than—in all—5 mg/l is obtained.

3. If desired, the content of polyvalent cations in the solution produced in step 2. is then further reduced by so-called selective cation exchangers.

4. The solution obtained after step 2. and, optionally, step 3. is then concentrated by single-stage or multistage evaporation to $Na_2CrO_4$ contents of 750 to 1000 g/l.

5. In this concentrated solution, a pH value below 6.5 is adjusted by the introduction of carbon dioxide in one or more stages up to a final pressure of 4 to 15 bar at a final temperature not exceeding 50° C., an at least 80% conversion of the sodium chromate into sodium dichromate being achieved in this way with precipitation of the sodium bicarbonate.

6. The sodium bicarbonate is separated off from this suspension either under continuing carbon dioxide pressure or after expansion; in the latter case, the sodium bicarbonate is separated off before it enters into a back-reaction with the sodium dichromate.

7. After removal of a sidestream for pH adjustment in step 1 and, optionally, after removal of a second sidestream for the production of sodium dichromate and, optionally after the addition of water, the resulting sodium chromate/sodium dichromate solution separated off from the sodium bicarbonate is then delivered to the anode compartment of a two-compartment cell with a cation-selective membrane as the dividing wall and is subjected to electrolysis at 50° to 90° C. in such a way that a solution essentially containing sodium dichromate is formed and may be brought to low temperatures to precipitate the sodium sulfate present therein in dissolved form.

8. The solution essentially containing sodium dichromate from step 7 is then subjected to a multistage, preferably 6- to 15-stage, electrolysis at 50° to 90° C. in two-compartment electrolysis cells with a cation-selective membrane as the dividing wall. This is done by introduction of the solution into the anode compartment of the first stage; after partial conversion of the dichromate into chromic acid, the solution then flows to the second stage, where more dichromate is converted into chromic acid, and so on in stages up to the final stage in which a 55 to 70% conversion of the dichromate into chromic acid is achieved, corresponding to a molar ratio of sodium ions to chromic acid of 0.45:0.55 to 0.30:0.70, there being no limit to the number of stages.

9. This solution, which contains chromic acid and a residue of sodium dichromate, is brought by evaporation to a water content of from about 12 to 15% by weight at temperatures in the range from 55° C. to 110° C., most of the chromic acid crystallizing out.

10. The suspension obtained is separated by centrifugation at 50° to 110° C. into a solid consisting essentially of cystalline chromic acid and a liquid phase, known as the mother liquor, which contains the sodium dichromate remaining in solution and the uncrystallized parts of chromic acid.

11. The mother liquor obtained is divided continuously or periodically or at irregular intervals in such a way that by far the major part or, periodically, even the entire quantity, optionally after dilution with water, is returned to the electolysis at a suitable point, i.e. at a stage where the conversion of dichromate is similar in degree, while a relatively small proportion of the mother liquor is added to the solutions mentioned in step 7 which contain sodium chromate and sodium dichromate alongside one another, but which are not used for the production of chromic acid, on the one hand to remove impurities from the electrolysis circuit and, on the other hand, to complete acidification to the sodium dichromate in the sodium chromate/sodium dichromate solutions mentioned.

12. The solid obtained in step 10 is freed from adhering mother liquor by a single wash or repeated washing with 10 to 50% by weight, based on the weight of the solid, of saturated or substantially saturated chromic acid solution, which is produced externally or in situ with water, at temperatures above 35° C. and by centrifugation after each wash.

13. The washing liquid accumulating is returned to the evaporation mentioned in step 9, the washing liquids accumulating in fractions in the event of repeated washing of the solid being useable as washing solution in the next centrifugation cycle by carrying out only the last wash(es) with pure chromic acid solution.

14. The pure, crystalline chromic acid produced in step 12 is then dried either at 130° C. to 190° by indirect heating or directly at 130° C. to 190° C. using heated gases free from reducing agents and undersaturated with steam or is used without any further treatment or processed to chromic acid solution.

15. The gases, oxygen and hydrogen, formed during the electrolysis are individually collected and optionally purified and are either burnt or put to another use.

16. The solution containing sodium ions which is formed in the cathode compartment during the electrolysis of chromate/dichromate solution in step 7 and the solution containing sodium ions which is formed in the cathode compartment in all the electrolysis stages in step 8 are combined and concentrated, optionally utilizing the heat of electrolysis generated in steps 7 and 8 and requiring dissipation.

The starting material used for the industrial production of the alkali metal chromates, alkali metal dichromates and, from them, chromic acid is exclusively which is exposed to the effect of oxygen-containing gases at temperatures above 1000° C. in admixture firstly with the sodium carbonate or sodium carbonate/sodium hydroxide or sodium hydroxide, occasionally with addition of alkaline earth metal oxides and/or carbonates, particularly calcium oxide and/or calcium carbonate, as alkaline fusion medium and, secondly in admixture with a leaning agent of essentially iron (III) oxide or hydroxide, preferably so-called back ore from the leaching step described hereinafter.

The furnace charge is leached with water in several stages, generally in countercurrent, being size-reduced at the same time, in order to obtain sodium chromate in the form of a solution containing approximately 300 to 500 g/l $Na_2CrO_4$. A pH value in the range from 7.0 to 9.5 has to be adjusted to ensure that the sodium chromate solution has a negligible content of foreign constituents. This pH adjustment may be carried out during the actual leaching process or in the solution obtained after separation from the leached solid. In order not to introduce any new impurities into the system, the necessary pH adjustment is carried out with dichromate or with chromic acid or with chromic acid/sodium dichromate mixtures or with sodium chromate/sodium dichromate solutions, preferably with those which accumulate at a later stage of the process after acidification with carbon dioxide under pressure, or with mixtures of the sodium chromate/sodium dichromate solutions preferably used with sodium dichromate/chromic acid solutions removed from the chromic acid electrolysis/crystallization circuit for the removal of impurities. After pH adjustment, the leached parts of the ground furnace charge which have remained undissolved, and/ where pH adjustment is carried out after separation from the leaching residue, the impurities precipitated during pH adjustment have to be filtered off or centrifuged off from the sodium chromate solution or separated off by allowing the solids to settle out. The leached residue of the furnace charge, so-called back ore, is partly returned as a mixing constituent to the digestion of chrome ore.

Unless the digestion of the chrome ore has been carried out in such a way that vanadium cannot pass into solution during leaching, the sodium chromate solution freed from the impurities capable of precipitation at pH 7.0 to 9.5 then has calcium added to it in known manner in the form of calcium oxide or calcium hydroxide in aqueous solution or suspension to precipitate the vanadium as calcium vanadate. The calcium is used in a stoichiometric excess, taking into account the calcium which has passed into solution during leaching of the furnace clinker.

To precipitate the polyvalent ions which have remained in solution despite pH adjustment, particularly the calcium ions used in excess, the sodium chromate solution remaining after separation of the calcium vanadate is brought to 50°-100° C. and preferably to 70°-85° C. and adjusted to pH 8-12 and preferably to pH 9.0-11.0 with sodium hydroxide and carbon dioxide and/or sodium carbonate and/or sodium bicarbonate. The carbon dioxide and/or sodium bicarbonate and/or sodium carbonate is added in a quantity which produces a concentration of carbonate ions of 0.01 to 0.18 mol/l and preferably of 0.03 to 0.1 mol/l in the solution. The precipitation may even be carried out in several stages with increasing contents of sodium chromate. Precipitation of the calcium, strontium and other polyvalent ions and, surprisingly, the fluoride as well takes place during a ripening and residence time of 5 to 360 minutes, during which the pH value is maintained, so that a sodium chromate solution with extremely low residual contents of impurities is obtained after separation of the precipitate. The sodium chromate solution thus produced contains residues of calcium and strontium of, together, less than 5 mg/l, while other polyvalent cations, such as barium, magnesium, iron, zinc, etc. and also fluoride ions are no longer present or are only present in a quantity below the particular detection limit, the detection limits lying between 0.5 and 1 mg/l. The precipitate filtered off surprisingly contains the cations precipitated almost exclusively as carbonates and as hydroxides and only to a very small extent as fluorides and chromates, although the latter in solution are clearly in the majority over carbonate and hydroxide ions.

It has now been found that it is of advantage for the subsequent step, i.e. the downstream step, of electrolysis of sodium dichromate/sodium chromate solution to sodium dichromate and, further, to chromic-acid-containing solution to reduce the content of polyvalent cations even further to values below 1 mg/l for each polyvalent cation still in solution. According to the invention, this object is achieved by passing the sodium chromate solution obtained in the previous steps through a so-called selective cation exchanger consisting of macroporous bead polymers based on crosslinked polystyrene with chelating groups, the chelating groups being substituents from the group consisting of

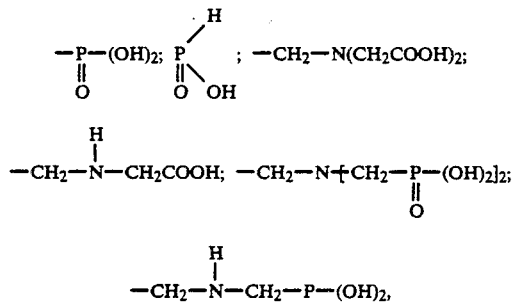

although the powder form or the gel form is also effective for the stirring-in process. It is of advantage to use bead polymers in which the H ions of the acid groups in the substituents are replaced by sodium ions.

The exchanger may be regenerated by treatment with acid and may be freed by washing with pure water from the residues of the extraneous ions introduced with the regenerating acid and may then be converted with sodium hydroxide into the sodium form so that the selective cation exchanger is then ready for use again. The various techniques for charging cation exchangers with the cations to be removed from solutions, arranging and operating various exchange units in series or in parallel and preferably regenerating them in alternation are known from the literature. The working temperature for the removal of the polyvalent cations from the sodium chromate solution is in the range from 20° to 90° C. and preferably in the range from 60° to 85° C. while the solution/exchanger contact time is at least 2 minutes and preferably 6 minutes and longer.

Before any further treatment, the sodium chromate solution is advantageously further concentrated by evaporation to $Na_2CrO_4$ contents of 750 g/l to 1000 g/l.

In the process according to the invention, carbon dioxide is used for the conversion of sodium chromate into sodium dichromate. This so-called acidification of the sodium chromate may be carried out in a single stage or in several stages; the first stage(s) may be operated in the absence of pressure, although for the desired end result of an at least 80% conversion of the sodium chromate into sodium dichromate, the last stage(s) has to be carried out under a carbon dioxide pressure of from 4 to 15 bar and preferably 8 to 15 bar at a final temperature below 50° C. and preferably below 30° C. An at least 90% conversion of the sodium chromate under a pressure of more than 8 bar is preferred. Where the conversion is carried out in several stages, it is of advantage to increase the carbon dioxide pressure from stage to stage and to combine the transport of the liquid phase with separation of the sodium bicarbonate precipitated after each stage, for example by centrifugation under pressure. On the other hand, it is also possible rapidly to separate the sodium bicarbonate precipitated after expansion by filtration, centrifugation or decantation, although in this case it is crucially important that expansion and phase separation be carried out very soon after one another on account of the possible back-reaction of sodium dichromate and sodium bicarbonate. The partial conversion of the sodium chromate into sodium dichromate is accompanied by conversion of the mixture of sodium hydroxide and sodium carbonate present in the sodium chromate solution from the preceding stages into sodium bicarbonate.

The sodium bicarbonate obtained may be converted by heat treatment and/or reaction with sodium hydroxide into sodium carbonate which may be used for digestion of the chrome ore.

A sidestream is removed from the solution now present, in which at least 80% and preferably at least 90% of the chromium (VI) is present as dichromate and which no longer contains polyvalent cations in detectable quantities, for the electrochemical production of chromic acid. Another sidestream is used for the above-described pH adjustment during/after leading of the furnace charge. If desired, further parts of the solution are used for the production of sodium dichromate by addition of sulfuric acid or by addition of chromic acid or by addition of chromic acid/sodium dichromate or by electrochemical acidification as described for example in U.S. Pat. No. 3,305,463 or as described hereinafter for the sidestream used for the production of chromic acid; these measures may also be taken at one and the same time. For example, the combination of electrochemical acidification with the simultaneous input of dichromate/chromic acid solution in batches or continuously is a suitable process for the complete conversion of the remaining sodium chromate into sodium dichromate in the sidestream which is not used for the production of chromic acid.

For the production of chromic acid, the corresponding sidestream is introduced into the anode compartments of a two-compartment electrolysis cell, in which the dividing wall between the anode and cathode compartments is a cation-selective membrane, and is electrolytically converted therein into a solution essentially containing sodium dichromate and only small quantities of sodium chromate and/or chromic acid. In general, a relatively large number of such electrolysis cells, which may be combined for example in the manner of filter presses, may be operated in parallel. The voltage required to obtain a current density of from 1 to 5 $kA/m^2$ and preferably from 2.5 to 3.0 $kA/m^2$ may be applied individually to each cell electrically insulated from the other or, where the cells are conductively interconnected, may be applied in a so-called bipolar circuit to the ends of such an electrically connected arrangement. The voltage to be applied is a function of the electrode intervals and the electrode design, the solution temperature, the solution concentration and the current and amounts to between 3.8 and 6.0 V per electrolysis cell.

Each electrolysis cell has an inlet in the anode compartment for the sodium chromate/sodium dichromate solution to be used and an outlet for the electrolyzed solution essentially containing sodium dichromate. The inlet and outlet are normally situated at opposite ends of the particular electrolysis cell, the inlet advantageously being situated in the lower part of the electrolysis cell and the outlet in the upper part thereof. The cathode compartments are similarly provided with inlets and outlets. Through separate openings in the frame of the cell or, preferably, through the same openings as for inlet and outlet, liquid is pump-circulated both from the anode compartment and from the cathode compartment through external heat exchangers for the purpose of dissipating heat. The streams to be pump-circulated from the anode compartment and cathode compartments as a whole are advantageously combined into an anolyte stream and a catholyte stream and are respectively passed through an anolyte cooler and a catholyte cooler. From these coolers, the cooled anolyte and catholyte liquids are redistributed among the individual anode and cathode compartments. This cooling keeps the temperature in the anode compartment and cathode compartment at 50° C. to 90° C. and preferably at 70° to 80° C.

Through separate openings in the frame in the upper part of the cell and at the same time or exclusively through the same opening as the outlets, the electrolysis products, oxygen and hydrogen, are removed from the anode compartments and cathode compartments. The gas streams are advantageously combined separately according to the gases and, optionally, freed from entrained solutions and then used, for example as a heating material and fuel in the chrome ore digestion furnace.

Water is introduced into the cathode compartment either directly through the inlets or by addition to the catholyte liquid in the cooling circuit, for example after the catholyte cooler.

Solution is removed from the anode compartments, for example under the control of an overflow, always in such a quantity that the molar quantity or chromium(VI) removed in a given time as the sum of sodium chromate, sodium dichromate and chromic acid is equal to the quantity of chromium(VI) introduced in the same time as the sum of sodium chromate and sodium dichromate. Cathode compartment liquid of the desired concentration is removed from the cathode compartments, for example regulated by an overflow and controlled by the water introduced into the cathode compartments. The cathode liquid generally consists of 8 to 30% and preferably about 12 to 20% sodium hydroxide. The cathode compartment liquid may be modified if desired by the introduction of agents which neutralize the alkali produced, for example carbon dioxide and/or sodium dichromate solution and/or sodium dichromate/sodium chromate solution from the above-mentioned acidification with carbon dioxide. In the continuous operation of the cells, alkali is removed in the same quantity per unit of time which is produced in the cathode compartments in the same unit of time by the transport of sodium from the anode compartments through the membranes into the cathode compartments. The concentration of cathode compartment liquid may be adjusted through the addition of water and is preferably selected as high as possible, being limited primarily by the membrane material used.

Cation-selective membranes, which may be used as dividing walls between the anode and cathode compartments of the two-compartment electrolysis cells used in the process according to the invention, have already been repeatedly described and have long been commercially available. High-stability membranes reinforced by fibers and cloths are preferred. It is possible to use both single-layer membranes and also two-layer membranes, consisting of two different membrane types arranged one above the other, the two-layer membranes offering greater resistance to the possible diffusion of hydroxide ions through the membrane, i.e. affording the advantage of higher current efficiency. The suitable membranes have a perfluorocarbon polymer structure with sulfonate exchange groups; suitable reinforcing materials are also fluorocarbon polymers, preferably polytetrafluoroethylene, commercially available for example as ®Nafion 324, Nafion 435, Nafion 430 and Nafion 423 (products of DuPont, USA).

The electrodes to be used on the cathode side are those which have already been successfully used in the electrolysis of alkali metal chlorides for the production of sodium hydroxide in various concentrations and generally consist of steel, stainless steel or nickel and may be activated to reduce the hydrogen overvoltage.

The electrodes to be used on the anode side must be resistant to attack by the acidic and oxidizing medium and to the electrolytically produced oxygen. They consist of a basic titanium structure and, optionally after the application of an intermediate layer of titanium oxide or tantalum oxide or tin oxide, are coated with platinum or with iridium-dominated platinum/iridium by wet electrodeposition or melt electrodeposition or by stoving. Suitable anode forms are those which have been successfully used in other gas-evolving processes, for example anodes in perforated plate form, expanded-metal anodes, knife anodes, spaghetti anodes and louvre anodes. The spacing between the electrodes is as small as possible and preferably less than 10 mm.

The electrolysis cells may be made of materials resistant to sodium dichromate, more especially titanium and post-chlorinated PVC.

The highly pure solution produced in this way, essentially containing sodium dichromate and only small quantities of sodium chromate or chromic acid, is then delivered completely or in part to a multistage electrolysis. To this end, the solution mentioned is introduced into the anode compartments of the first stage where it is partly converted into chromic acid and then introduced into the anode compartments of the second stage where it is again partly converted into chromic acid and so on through the third, fourth and further stages to the final stage. The degrees of conversion of the sodium dichromate into chromic acid in the individual stages are gauged in such a way that 55 to 70% and preferably 59 to 65% conversion takes place in the final stage so that a ratio of sodium ions to chromic acid of from 0.45:0.55 to 0.3:0.7 and preferably from 0.41:0.59 to 0.35:0.65 is obtained.

The electrolysis cells used for this conversion in all the stages are of the same type as those described in the last paragraph for the conversion of the sodium chromate/sodium dichromate solution into a solution essentially containing sodium dichromate and are preferably set up and operated together with those electrolysis cells so that their current and voltage supply and also their hydrogen and oxygen purification and disposal and the treatment, cooling, concentration and disposal of their cathode compartment liquid can be combined. In particular, the same monopolar or bipolar current and voltage supply is selected. In this case, too, the current density is between 1 and 5 $kA/m^2$ and preferably between 2.5 and 3.0 $kA/m^2$ while the voltage to be applied per electrolysis cell is between 3.8 and 6.0 volts. Although higher voltages are possible, they are avoided both on economic grounds and on technical grounds. The product of the preceding stage is fed to the electrolysis cells through the inlet of the anode compartments while the product is introduced to the next stage throught the outlet. In each stage, the anolytes are collected and passed through a heat exchanger for the purpose of heat dissipation and are returned cooled on the opposite side of the anode compartment in the lower part thereof. Accordingly, the total number of heat exchangers for anolytes is equal to the number of electrolysis stages. The catholytes may be combined for all the stages and are then cooled together, preferably combined with the cathode liquid from the above-described step of the conversion of sodium chromate/sodium dichromate into sodium dichromate solution and then redistributed among the individual cathode compartments. Commensurately with the introduction of water into the cathode compartments or into the cooled cathode compartment liquid to be distributed among the cathode compartments, cathode compartment liquid is removed from the circuit and further processed, for example by concentration. One preferred form of further processing is concentration by evaporation in vacuo in one to three evaporator stages utilizing the heat released during electrolysis, so that at least some of the heat exchangers by which the heat of electrolysis is dissipated from the catholyte liquid are identical with some of the heat exchangers used for evaporation of the removed cathode compartment liquid. The composition of the cathode compartment liquid is the same as that of the preceding stage of the conversion of sodium chromate/sodium dichromate solution into sodium dichromate solution. In all the stages, the temperatures of the solutions in the electrolysis cells are in the range from 50° to 90° C. and preferably in the range from 70° to 80° C. The membranes, anodes and cathodes to be used and the materials to be used for their construction are the same as described above.

In order to achieve uniform strain all the electrolysis cells involved in the process and their constituents, such as membranes, electrodes and frames, by the media treated therein, the cells may be modified in their function at certain time intervals to the extent that they create another sodium dichromate/chromic acid conversion stage by changing the direction of flow of the anode compartment liquids. Thus, by total reversal of the direction of flow of the anolyte, the electrolysis stage with, hitherto, the highest conversion into chromic acid can take over the function of the stage with the lowest conversion and vice versa.

Accordingly, by partially, as opposed to totally, changing the direction of flow of the anode compartment liquids, each cell arrangement can take over the function of each electrolysis stage in sequence.

The anode compartment liquid removed from the last stage of the multi-stage electrolysis process is delivered to a single-stage to three-stage evaporation process, of which the last stage is formed by an evaporation crystallizer. The liquid is evaporated to such an extent that crystallization of chromic acid occurs by the exceeding of the solubility limit. The liquid is preferably evaporated to a water content in the mixture of from 9 to 20% by weight and, more preferably, to a water content of from 12 to 15% by weight. The temperature to be established in the crystallizer is in the range from 50° to 110° C., preferably in the range from 55° to 80° C. and more preferably of the order of 60° C. Various types of crystallizers or crystallization evaporators with an internal heating compartment or with an external heating circuit are suitable for the preferably continuous crystallization process. They must always be operated at reduced pressure so that evaporation can be carried out at the temperatures mentioned above. It is preferred to use crystallizers of titanium which enable a crystallizate free from fine grain to be produced, i.e. crystallizers in which the crystal suspension is at least partly graded according to crystal size during operation. The crystallizers in question are FC (forced-circulation) crystallizers and also draught-tube crystallizers, for example in combination with hydrocyclones or settling tanks; even more suitable are draught-tube crystallizers with a clarifying zone, for example DP (double-propeller) crystallizers and fluidized-bed crystallizers (see W. Wohlk, G. Hofmann, International Chem. Engineering 27, 197 (1987); R. C. Bennet, Chemical Engineering 1988, pages 119 et seq).

The crystal sludge taken from the crystallizer may be further thickened in a liquid cyclone (hydrocyclone) or settling tank and is delivered either directly or after thickening to a centrifuge of which the parts coming into contact with liquids are made of titanium. The liquid is centrifuged off as far as possible from the crystal cake, after which the crystal cake is washed once or several times, preferably once to three times, with saturated or substantially saturated chromic acid solution. The saturated or substantially saturated chromic acid solution may be prepared outside the centrifuge by dissolution of chromic acid, preferably by dissolution of part of the purified chromic acid in the form of the moist, washed filter cake and/or by dissolution of a sieved fine-grain component from the crystalline chromic acid produced in the last stage of the process, although it may also be prepared in the centrifuge itself by spraying of water or dilute chromic acid solution onto the filter cake. The total quantity of water to be used for washing is between 3 and 25% by weight, based on the moist centrifuge cake (filter cake), and preferably between 4 and 10% by weight. This quantity of water is added to the filter cake to be washed all at once or in portions either as such or in the form of a chromic acid solution. Where washing solution is added in several portions, the resulting solutions flowing off from the filter cake may be collected together or even separately. Where they are separately collected, the effluents contaminated differently and increasingly from one washing step to the next are reused as washing solution for the preceding washing stages in the next centrifugation cycle. The effluent from the first washing step after removal of the mother liquor by centrifugation or, where the cake is washed in a single stage, the entire washing liquid running off is delivered to the evaporation crystallizer, the temperature of the solution being maintained or increased en route.

The mother liquor of the chromic acid crystallization flowing off from the centrifuge, which is saturated or slightly oversaturated with chromic acid, is mostly delivered without further cooling to the anode side of the multistage electrolysis of sodium dichromate to chromic acid. Of the various electrolysis stages, that stage which corresponds soonest to the degree of conversion of the inflowing mother liquor is selected for the introduction of the mother liquor of which the composition of sodium dichromate and chromic acid corresponds to a conversion of the sodium dichromate into chromic acid of approximately 50%. The particular electrolysis stage may be determined by calculation and/or by experiment. Providing all the electrolysis stages have the same or substantially the same electrode and membrane areas and are operated at the same current density, as is preferably the case, the fourth electrolysis stage of an eight-stage plant for example is suitable for receiving the mother liquor, whereas, in an eleven-stage electrolysis plant, the fifth electrolysis stage is suitable for receiving the mother liquor. To increase conductivity, water may be added to the mother liquor before it enters the selected electrolysis stage or the corresponding quantity of water is directly introduced into the anode compartments or into the associated cooling circuit of the anode liquid. Any water added is limited in quantity so that the water content of the resulting solution does not exceed 50% by weight, i.e. is between 25 and 50% by weight.

For the removal of impurities which have been introduced into the electrolysis circuit, a relatively small part of the mother liquor flowing off from the centrifuge is passed into the upstream acidification stages, i.e. either into the sidestream removed in process step 7 for pH adjustment in step 1 or, as preferred, into the sidestream removed in step 7 for the preparation of sodium dichromate. In the first case, the solution removed again passes through all the purification stages mentioned for the removal of collected impurities; in the second case, the solution removed leaves the chromic acid production process altogether. Wherever reference is made to the smaller part of the mother liquor flowing off from the centrifuge, the part in question is the smaller part as a long-term time average. In the short term, there is no need for impurities to be removed in this way because of course only very small, barely measureable quantities of impurities are introduced into the electrolysis system with the sodium chromate/sodium dichromate solution in step 7. Equally, should it be necessary for economic reasons, a very large proportion of mother liquor may be removed for a limited period to be used elsewhere for pH regulation and for chromate/dichromate conversion by virtue of its high acid content. In the present context, the short term is understood to be a period of no more than about thirty times that period in which the average volume of sodium dichromate solution flowing in from step 7 of the multi-stage electrolysis reaches the total anode liquid volume of the multistage electrolysis, including cooling circuits and the crystallizer and any stacking containers incorporated in this anode liquid stream. However, the removal of a small part of the mother liquor at regular intervals into the streams of sodium dichromate solution from step 7, which are used for the production of sodium dichromate or for pH adjustment in step 1, is preferred to removal of mother liquor at irregular intervals.

A small part of the mother liquor is understood to mean a fraction containing between 2% and 20% and preferably between 5% and 10% of that molar quantity of chromium(VI) which is introduced into the multistage electrolysis from step 7.

After removal or discharge from the centrifuge, the pure, crystalline, moisture-bearing chromic acid produced in step 12 may be converted into batchable product in various ways. Where a chromic acid solution prepared outside the centrifuge is used for washing the chromic acid crystals in step 12, this moist chromic acid crystal cake is suitable for that purpose and a corresponding amount is removed. A marketable, high-purity chromic acid solution may also be prepared from the moist crystal cake without any further treatment. To obtain dry, crystalline product, water has to be removed below the decomposition temperature of chromic acid, i.e. at a temperature below 195° C. and preferably at a temperature in the range from 165° to 185° C. This may be done on the one hand by indirect heating with steam or with a circulating liquid; if desired, the material to be dried may be kept under reduced pressure, or even by direct heating with hot gas which contains no fractions with a reducing effect below 195° C. and which is clearly undersaturated with water. Apparatus in which chromic acid can be dried by the known principles of contact drying or convection drying are described inter alia in Ullmanns Enzyklopädie der technischen Chemie, 4th Edition, Vol. 2, pages 698 et seq (more especially pages 707 to 717), Weinheim 1972. It is preferred to use apparatus which avoid or minimize mechanical abrasion of the crystals, i.e. apparatus in which the chromic acid crystals are moved only slowly and to a minimal extent, if at all, including slowly rotating, externally heated revolving tubes.

Drying may be followed by dust removal by sifting or grading for the removal of dust-like or finely crystalline fractions. The fine material separated off may be used for the preparation of chromic acid solution for the washing—in the centrifuge in step 12—of the chromic acid crystals removed by centrifugation.

The gases formed during electrolysis, namely oxygen in the anode compartment and hydrogen in the cathode compartment, are individually removed from the electrolysis compartments, normally from the upper part of the electrolysis cell and together with the particular anode compartment liquid and cathode compartment liquid. To remove entrained fine droplets of anode compartment liquid and cathode compartment liquid, the gas streams may be washed, for example, with water or passed through so-called drop eliminators or mist eliminators. In order safely to remove above all traces of chlorine which can result from a small content of chloride in the sodium chromate and sodium dichromate solutions used, contacting of the oxygen stream with a chlorine-reactive absorbent, for example aqueous sodium hydroxide and moist active carbon, is recommended.

Unless another use is preferred, both the oxygen and the hydrogen are delivered through separate pipes to the chrome ore digestion furnace where they are respectively used as oxidizing agent and as fuel. However, it is also possible to burn the hydrogen and to discharge the oxygen into the atmosphere.

In the electrolysis of sodium chromate/sodium dichromate solution to sodium dichromate solution and during the further multistage electrolysis thereof to a chromic acid/sodium dichromate solution, a sodium alkali product is formed in addition to hydrogen in the cathode compartments from the hydroxide ions produced at the cathode and the sodium ions which have migrated from the anode compartments through the cation-selective membranes, as already described above.

For the removal of dissolved or finely divided hydrogen from the solution removed from the cathode liquid cooling circuit, the solution may be treated, for example by heating at normal pressure, before further processing, preferably evaporation in vacuo. The sodium alkali product from the cathode compartments is preferably used for the production of solid sodium carbonate for digestion of the chrome ore and as a conditioning medium for the chrome ore residue and for sodium chromate solution. Intermediate stage en route to the solution sodium carbonate may be: dilute and concentrated sodium hydroxide, sodium carbonate solutions, sodium bicarbonate.

What is claimed is:

1. In a process for the production of chromic acid by multistage electrolysis of dichromate solutions, monochromate solutions, or mixture of dichromate and monochromate solutions in two-compartment electrolysis cells, comprising an anode compartment and a cathode compartment, of which the anode and cathode compartments are separated by cation exchanger membranes, at temperatures in range from 50° to 90° C., wherein the dichromate solutions, or monochromate solutions, or mixture of dichromate and monochromate solutions are obtained by the digestion of chrome ores and leaching, wherein the improvement comprises (a) adjusting the pH of the monochromate solution obtained after leaching at 20° to 110° C. to a pH value of from 8 to 12 by the addition or in situ formation of carbonate in a quantity of from 0.1 to 0.18 mol/l for 300 to 500 g/l $Na_2CrO_4$, (b) separating the precipitated carbonates or hydroxides, (c) concentrating the solution to a content of 750 to 1000 g/l $Na_2CrO_4$, (d) converting with $CO_2$ under pressure into a dichromate-containing solution, (e) introducing the dichromate-containing solution into the anode compartment of the first stage electrolysis cell, (f) withdrawing an anolyte containing chromic acid in the last stage electrolysis cell, in which the molar ratio of $Na^+$-ions to chromic acid is from 0.41:0.59 to 0.35:0.65, and evaporating water from the said anolyte in vacuo in the temperature range of 55° to 80° C., crystallizing chromic acid, and separating chromic acid crystals from the said anolyte.

2. A process according to claim 1, wherein the electrolysis temperature is in the range from 70° to 80° C.

3. A process according to claim 1, wherein the electrolysis is carried out in 6 to 15 stages.

4. A process according to claim 1, wherein the ratio of Na ions to chromic acid is adjusted to 0.4:0.6.

5. A process according to claim 1, wherein the starting monochromate solution is treated with a cation exchanger.

6. A process according to claim 1, wherein the electrolysis is carried out at a current density of 1 to 5 $kA/m^2$ anode surface.

7. A process according to claim 1, wherein a mother liquor is obtained during working up of the chromic acid is completely or partly recycled into the electrolysis process circuit.

8. A process according to claim 1, wherein the crystallization is carried out by evaporation of water at temperatures in the range from 60° to 80° C.

9. A process according to claim 1, wherein part of the mother liquor accumulating during crystallization of the chromic acid is removed from the electrolysis cell.

10. A process according to claim 1, wherein the pH adjustment is carried out after removal of aluminum, vanadium and other impurities.

* * * * *

UNITED STATES PATENT AND TRADEMARK OFFICE
CERTIFICATE OF CORRECTION

PATENT NO. : 5,068,015

DATED : November 26, 1991

INVENTOR(S) : Block et al.

It is certified that error appears in the above-identified patent and that said Letters Patent is hereby corrected as shown below:

| | |
|---|---|
| Title Page | [56] References Cited: Insert -- U.S. PATENT DOCUMENTS<br>3,454,478 7/1969 Carlin...204/130<br>3,046,091 7/1962 Hoozer...23/56<br>3,305,463 2/1967 Carlin...204/89 -- |
| Col. 16, line 16 | After " liquor " delete " is " |
| Col. 16, line 18 | Delete " process " |

Signed and Sealed this

Sixth Day of July, 1993

*Attest:*

Michael K. Kirk

MICHAEL K. KIRK

*Attesting Officer*

*Acting Commissioner of Patents and Trademarks*